US008340563B2

(12) United States Patent
Nakajima et al.

(10) Patent No.: US 8,340,563 B2
(45) Date of Patent: Dec. 25, 2012

(54) SHEET CONVEYING APPARATUS AND IMAGE FORMING APPARATUS

(75) Inventors: Keita Nakajima, Suntou-gun (JP); Takashi Kuwata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 12/762,648

(22) Filed: Apr. 19, 2010

(65) Prior Publication Data

US 2010/0278572 A1 Nov. 4, 2010

(30) Foreign Application Priority Data

Apr. 30, 2009 (JP) ..... 2009-111006

(51) Int. Cl.
*G03G 15/00* (2006.01)

(52) U.S. Cl. ..... 399/389; 399/394

(58) Field of Classification Search ..... 399/389
See application file for complete search history.

(56) References Cited

U.S. PATENT DOCUMENTS

| | | | | |
|---|---|---|---|---|
| 5,700,006 | A | 12/1997 | Sekiya et al. | |
| 5,765,826 | A | 6/1998 | Isoda et al. | |
| 6,527,267 | B1 | 3/2003 | Kuwata et al. | |
| 6,581,922 | B2 | 6/2003 | Kuwata et al. | |
| 6,643,480 | B2 | 11/2003 | Kuwata et al. | |
| 6,661,995 | B2 | 12/2003 | Isobe et al. | |
| 6,674,976 | B2 | 1/2004 | Sato et al. | |
| 6,816,229 | B2 * | 11/2004 | Oono | 355/18 |
| 6,871,042 | B2 * | 3/2005 | Nemura et al. | 399/389 |
| 6,912,044 | B2 | 6/2005 | Sekiyama et al. | |
| 6,973,285 | B2 | 12/2005 | Sekiyama et al. | |
| 6,988,730 | B2 | 1/2006 | Fukatsu et al. | |
| 6,997,456 | B2 | 2/2006 | Fukatsu et al. | |
| 7,530,565 | B2 * | 5/2009 | Terao et al. | 271/207 |
| 7,742,736 | B2 * | 6/2010 | Kobayashi et al. | 399/389 |
| 7,758,044 | B2 * | 7/2010 | Nonaka | 271/274 |
| 7,817,957 | B2 * | 10/2010 | Oohara et al. | 399/388 |

FOREIGN PATENT DOCUMENTS

| | | |
|---|---|---|
| JP | 2006-143420 | 6/2006 |
| JP | 2006-175611 | 7/2006 |
| JP | 2008-094600 | 4/2008 |
| JP | 2008-189449 | 8/2008 |

* cited by examiner

*Primary Examiner* — Anthony Nguyen
(74) *Attorney, Agent, or Firm* — Fitzpatrick, Cella, Harper & Scinto

(57) ABSTRACT

A sheet conveying apparatus including: a sheet conveying path through which a sheet is conveyed; a sensor unit configured to output a signal according to a characteristic of the sheet which is conveyed through the sheet conveying path; a pressure unit configured to press the sheet against the sensor unit; and a moving member protruding into the sheet conveying path, the moving member being moved by being pushed by the sheet passing through the sheet conveying path, wherein the pressure unit is interlocked with the moving member so that the sheet is pressed by the pressure unit against the sensor unit when the moving member is not pushed by the sheet, and a pressure force on the sheet applied by the pressure unit is released or reduced when the moving member is pushed by the sheet.

15 Claims, 10 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus.

2. Description of the Related Art

There is an image forming apparatus in which a sheet discriminating device such as an optical sensor is provided for automatically discriminating the type of a sheet (see Japanese Patent Application Laid-Open No. 2008-94600). A technology for controlling development conditions, transfer conditions, fixing conditions, or the like according to the discriminated type of the sheet is proposed (see Japanese Patent Application Laid-Open No. 2006-175611).

Further, conventionally, in a color laser printer, for example, single-color tone patches of yellow (Y), magenta (M), cyan (C), and black (K) or patches of colors made by mixing C, M, and Y are formed on a sheet. Further, density or chromaticity of the patches on the sheet is detected by an optical sensor after the patches are fixed. Further, there is proposed a technology for controlling the density or chromaticity of an ultimate output image which is formed on the sheet by feeding the result of the detection back to a calibration table for calibrating an amount of exposure, process conditions, and density-tone characteristics of the image forming portion (see Japanese Patent Application Laid-Open No. 2006-143420).

Still further, conventionally, in a sheet feeding apparatus for supplying a sheet to an image forming apparatus, an ultrasonic generator and an ultrasonic receiver are provided so as to be opposed to each other and so as to sandwich therebetween a sheet conveying path through which the sheet passes such that whether a double feeding occurs or not is detected based on the amount of attenuation of the ultrasonic wave. Further, there is proposed a technology for optimizing the rotation speed of a sheet feeding roller according to the result of the detection (see Japanese Patent Application Laid-Open No. 2008-189449).

In a conventional image forming apparatus in which the type of a sheet and the double feeding of sheets are detected using those technologies, in order to perform appropriate control, it is necessary to improve the detection accuracy of the detecting means such as a sensor. When, for example, a characteristic of the sheet such as the type of the sheet is detected by the detecting means, if the sheet flutters at a detecting position of the detecting means, the detection accuracy is reduced. In this context, in order to suppress a flutter of the sheet at the detecting position of the detecting means, a pressure-contacting means may bring the sheet into pressure contact with a guide provided in the vicinity of the detecting means to thereby improve the detection accuracy of the detecting means. However, if such a structure is adopted, a sheet which is conveyed is brought into pressure contact with the guide at all times even when the detecting means does not carry out detection, that is, even when the prevention of the flutter of the sheet is not required. In this case, in the context of recent demand for higher durability, there is apprehension that the guide is abraded by sheets because, when a sheet is conveyed, the sheet slides while the whole sheet from its leading edge to its trailing edge is in pressure contact with the guide. If the guide is abraded in this way, the amount of abrasion of the guide increases as the number of sheets which passes increases, and there is a fear in that, ultimately, the position of the sheet is away from the focal position of the sensor or the flutter of the sheet cannot be suppressed. As a result, the detection accuracy of the detecting means is reduced.

SUMMARY OF THE INVENTION

The present invention is made in view of the above-mentioned circumstances, and an object of the present invention is to provide a sheet conveying apparatus and an image forming apparatus which can prevent reduction of the detection accuracy of the detecting means.

The present invention provides a sheet conveying apparatus, including a sheet conveying path through which a sheet is conveyed; a sensor unit configured to output a signal according to a characteristic of the sheet which is conveyed through the sheet conveying path; a pressure unit configured to press the sheet against the sensor unit; and a moving member protruding into the sheet conveying path, the moving member being moved by being pushed by the sheet passing through the sheet conveying path, wherein the pressure unit is interlocked with the moving member so that the sheet is pressed by the pressure unit against the sensor unit when the moving member is not pushed by the sheet, and a pressure force on the sheet applied by the pressure unit is released or reduced when the moving member is pushed by the sheet.

As force from a sheet which is conveyed through the sheet conveying path moves the holding member configured to hold the pressure member according to the present invention, the reduction in the detection accuracy of the detection unit can be prevented at a low cost.

Further features of the present invention will become apparent from the following description of exemplary embodiments with reference to the attached drawings.

DESCRIPTION OF THE EMBODIMENTS

Figure 1:
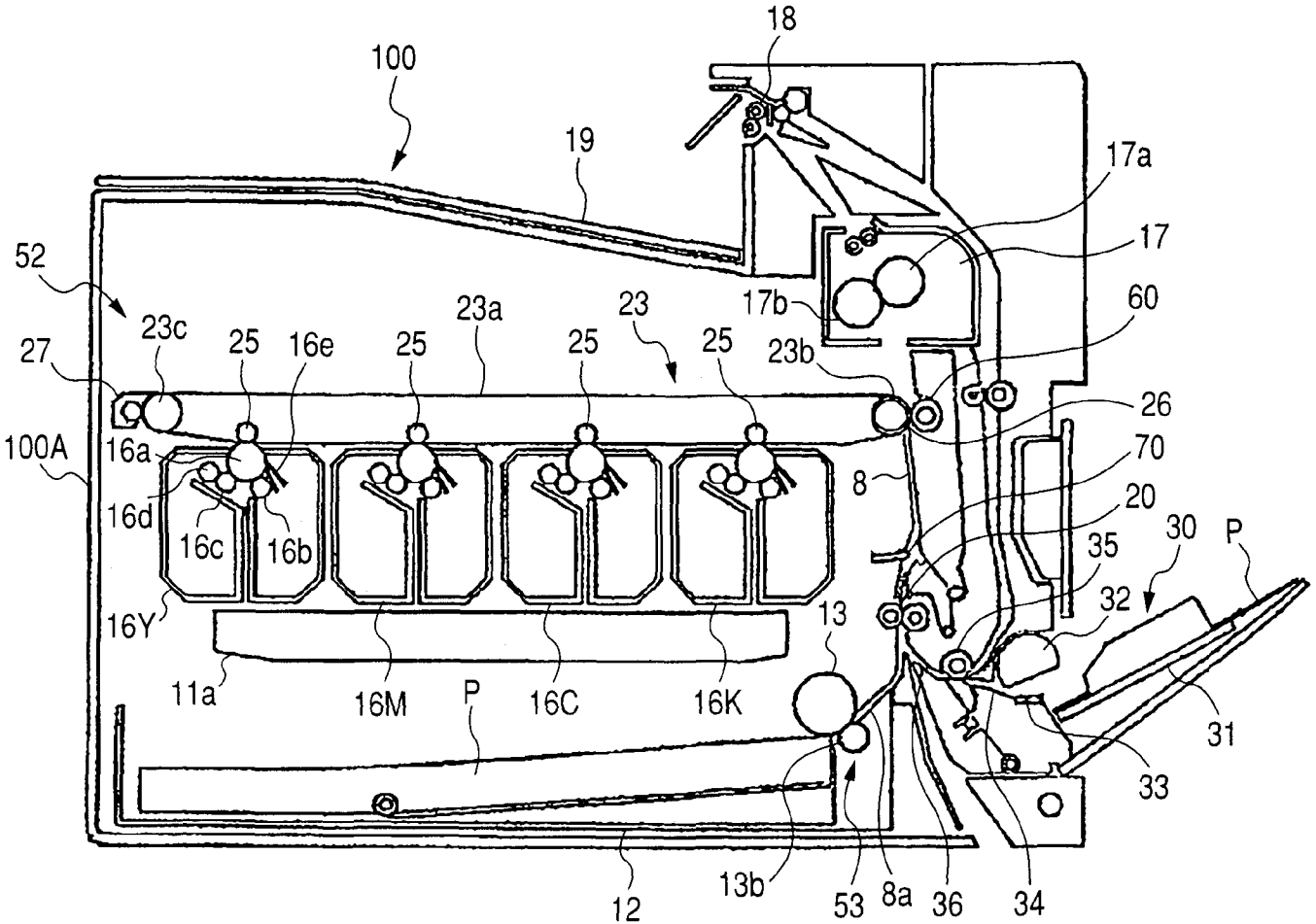
FIG. 1 illustrates a schematic structure of a laser printer as an example of an image forming apparatus including a sheet conveying apparatus according to a first embodiment of the present invention.

Embodiments of the present invention are described in detail in the following with reference to the attached drawings. FIG. 1 illustrates a schematic structure of a sheet conveying apparatus according to a first embodiment of the present invention and a full color laser beam printer as an example of an image forming apparatus including the sheet conveying apparatus. FIG. 1 illustrates a full color laser printer 100 and a full color laser printer main body (hereinafter referred to as an apparatus main body) 100A. The apparatus main body 100A includes an image forming portion 52 configured to form an image on a sheet, a sheet feeding apparatus 53 configured to feed a sheet, and a fixing portion 17 configured to fix a toner image formed on the sheet.

The image forming portion 52 includes process cartridges 16 (16Y, 16M, 16C, 16K) which are detachably mounted in the apparatus main body 100A to form toner images of four colors of yellow, magenta, cyan, and black, respectively, each process cartridge including a photosensitive drum 16*a*. The image forming portion 52 further includes a scanner unit 11*a* disposed immediately below the process cartridges 16 for irradiating a laser beam based on image information to form an electrostatic latent image on the photosensitive drums 16*a*.

Each of the process cartridges 16 includes, in addition to the photosensitive drum 16*a*, a charging roller 16*b* configured to charge uniformly a surface of the photosensitive drum, a developing roller 16*c*, a developer applying roller 16*d*, and a drum cleaning blade 16*e*. The fixing portion 17 applies heat and pressure to an image formed on the sheet to fix the toner image, and includes a heating roller 17*b* having a heater in the heating roller 17*b* and a pressure roller 17*a* in pressure contact with the heating roller 17*b*. The sheet feeding apparatus 53 includes a sheet feed cassette 12 configured to contain sheets P, a sheet feed roller 13 configured to feed a sheet P from the sheet feed cassette, and a separating roller 13*b* as a separating means. The sheet feed cassette 12 is inserted so as to abut against a positioning portion of the apparatus main body 100A. The sheets P contained in the sheet feed cassette 12 are in pressure contact with the sheet feed roller 13 and are separated from each other one by one by the separating roller 13*b* to be conveyed. The separated sheet P is conveyed to a registration roller pair 20 through a main body sheet conveying path 8*a*.

An intermediate transferring belt unit 23 includes an intermediate transferring belt 23*a* which rotates counterclockwise. The intermediate transferring belt 23*a* is extended between a drive roller 23*b* and a tension roller 23*c* and tension is applied to the intermediate transferring belt 23*a* by the tension roller 23*c*. Primary transferring rollers 25 are provided inside the intermediate transferring belt 23*a* so as to be opposed to the photosensitive drums 16*a*, respectively, such that a transferring bias is applied by a bias applying means (not shown). As described in the following, by the primary transferring rollers 25 applying a primary transferring bias to the intermediate transferring belt 23*a*, the toner images of the respective colors on the photosensitive drums are transferred onto the intermediate transferring belt 23*a* in sequence, thereby forming a full color image on the intermediate transferring belt. A secondary transferring portion 26 for transferring the full color image formed on the intermediate transferring belt 23*a* onto the sheet includes the drive roller 23*b* and a secondary transferring roller 60. A manual sheet feeding portion 30 includes an inner plate 31, a manual feed roller 32, and a separating pad 33 as a separating means.

Next, an image forming operation of the full color laser printer 100 structured in this way is described. When an image forming signal is output from a control portion (not shown) which is provided in the apparatus main body 100A, laser light is irradiated from the scanner unit 11*a* onto the photosensitive drum. Here, the surface of the photosensitive drum 16*a* is in advance uniformly charged by the charging roller 16*b* so as to have a predetermined polarity and a predetermined potential. By irradiating laser light from the scanner unit 11*a*, an electrostatic latent image is formed on the surface of the photosensitive drum 16*a*. After that, the electrostatic latent image is developed with toner and is visualized. For example, first, laser light based on an image signal for yellow component color is irradiated from the scanner unit 11*a* onto the photosensitive drum 16*a* of the process cartridge 16Y to form a yellow electrostatic latent image on the photosensitive drum. The yellow electrostatic latent image is then developed with yellow toner from the developing roller 16*c* and the developer applying roller 16*d* and is visualized as a yellow toner image.

Then, when the toner image reaches a primary transferring portion at which the photosensitive drum 16*a* and the intermediate transferring belt 23*a* abut each other as the photosensitive drum 16*a* is rotated, the yellow toner image on the photosensitive drum is transferred onto the intermediate transferring belt by the primary transferring bias applied to the primary transferring roller 25. After that, the portion of the intermediate transferring belt 23*a* which bears the yellow toner image moves. Then, a magenta toner image which is by that time formed on the photosensitive drum of the process cartridge 16M in a similar way is transferred onto the intermediate transferring belt 23*a* so as to overlie the yellow toner image. Similarly, as the intermediate transferring belt 23*a* moves, a cyan toner image and a black toner image are transferred at the respective primary transferring portions so as to overlie the yellow toner image and the magenta toner image. In this way, the full color toner image is formed on the intermediate transferring belt. Toner which remains on the surface of the photosensitive drums after the toner images are transferred is removed by the drum cleaning blades 16*e*.

In parallel with the toner image forming operation, a sheet P contained in the sheet feed cassette 12 is fed by a feeding roller 13 provided in the sheet feeding apparatus 53 and reaches the registration roller pair 20 provided in a sheet conveying path 8. The sheet P is, with the timing being controlled by the registration roller pair 20, conveyed to the secondary transferring portion 26. The sheets P on the inner plate 31 of the manual sheet feeding portion 30 are brought into pressure contact with the manual feed roller 32 as the inner plate 31 goes up. After that, the sheets are separated from each other one by one by the separating pad 33 and the rotation of the manual feed roller 32 and are conveyed. The separated sheet P is conveyed to a sheet re-feed roller pair 35 via a manual feed sheet conveying path 34, and then passes through a sheet re-conveying path 36 to be conveyed to the registration roller pair 20 provided in the sheet conveying path 8. After that, with the timing being controlled by the registration roller pair 20, the sheet P is conveyed to the secondary transferring portion 26.

Then, in the secondary transferring portion 26, the toner image of the four colors on the intermediate transferring belt is collectively transferred to the sheet by a secondary transferring bias applied to the secondary transferring roller 60. Toner which remains on the intermediate transferring belt after the secondary transfer to the sheet P is removed by a transferring belt cleaning device 27, and the removed toner is collected in a waste toner container (not shown) which is disposed in a back portion of the apparatus. Then, the sheet P onto which the toner image is transferred is conveyed to the fixing portion 17. When the sheet P passes through a nip formed by the heating roller 17*b* and the pressure roller 17*a*, the toner image on the sheet which is not fixed as yet is heat-fixed. As a result, a full color print image is fixed on the sheet as a permanent image. After the full color print image is fixed as a permanent image, the sheet P is delivered and stacked in a sheet stacking portion 19 by a delivery roller pair 18.

Figure 2:
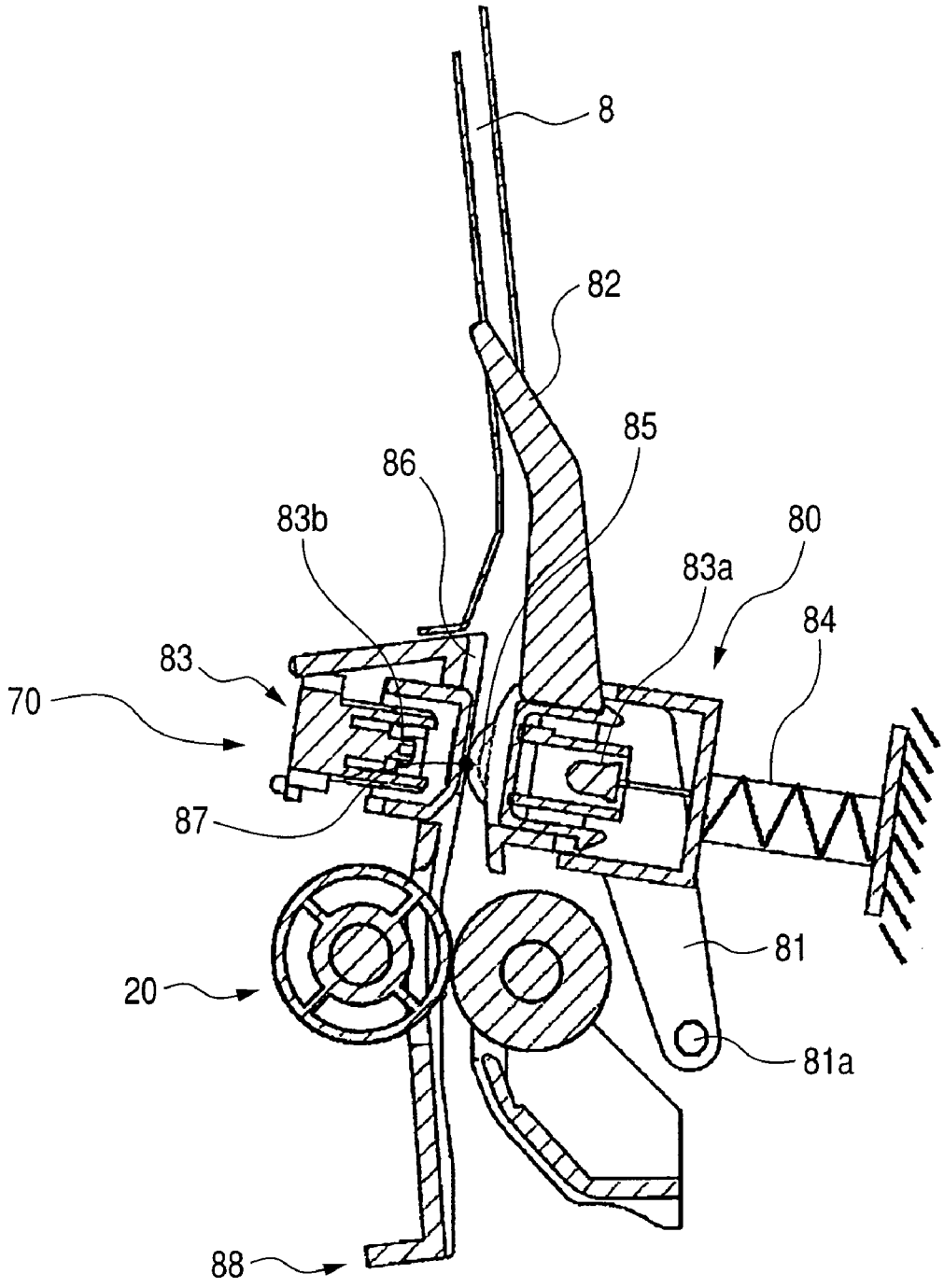
FIG. 2 illustrates a structure of a conveyance unit as the sheet conveying apparatus.

In FIG. 1, a conveyance unit 70 is a sheet conveying apparatus for conveying the sheet P which is fed from the sheet feeding apparatus 53 or the manual sheet feeding portion 30 to the secondary transferring portion 26. As illustrated in FIG. 2, the conveyance unit 70 includes a conveyance guide unit 88, a sheet discrimination unit 83, and a sheet pressure-contact unit 80. Here, the sheet discrimination unit 83 has an LED 83*a* for transmitted light and a discriminating sensor portion 83*b* which includes an LED for reflected light and an image reading sensor. The conveyance guide unit 88 and the sheet discrimination unit 83 form a sensor unit. The sheet discrimination unit 83 is provided for discriminating a characteristic of a sheet such as the thickness or the type. A control portion (not shown) performs control such that an image formation condition is changed according to the characteristic of the sheet which is discriminated by the sheet discrimination unit 83. The sensor portion 83*b* of the sheet discrimination unit 83 outputs a signal according to a characteristic of a sheet such as the thickness or the type and the output signal from the sensor portion 83*b* is send to the control portion. The control performed by the control portion may be the following.

For example, when the type (the surface) of the sheet is gloss paper the gloss of which is higher than that of plain paper, control is performed such that the developing bias is made higher than that with regard to plain paper to increase the amount of toner which adheres to the surface of the sheet, thereby increasing the gloss of the image on the sheet. Further, control is performed such that the fixing temperature is changed according to the thickness of the sheet. For example, when the sheet is heavy paper which is thicker than plain paper, because the heat capacity of the heavy paper is larger than that of the plain paper, if the fixing temperature when the toner image is fixed on the heavy paper is the same as that for the plain paper, the fixability becomes worse. Therefore, when the result of the discrimination is that the sheet is heavy paper, control is performed such that the fixing temperature is higher than that for the plain paper to ensure the fixability of toner on the heavy paper.

Figure 3:
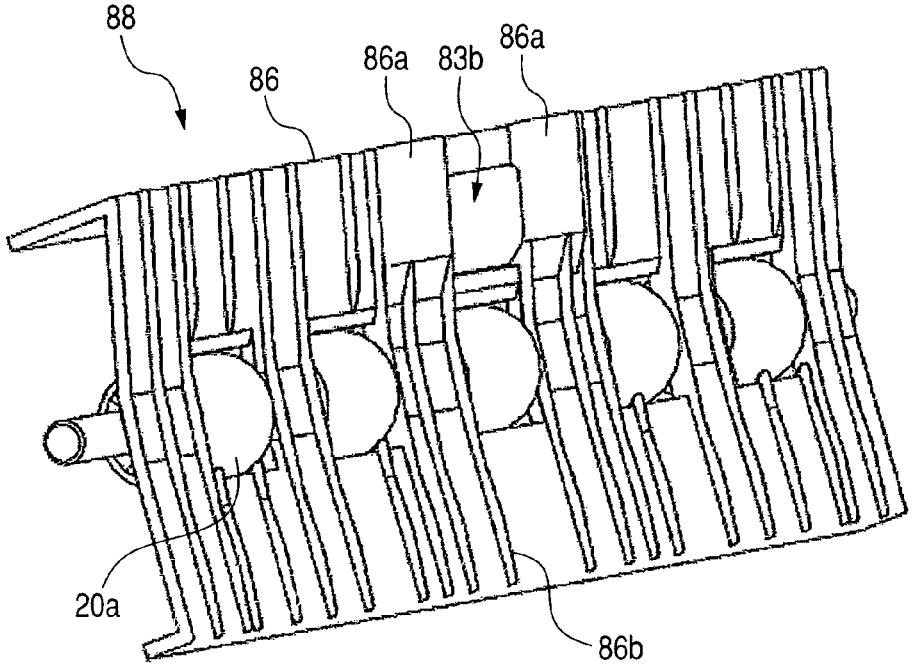
FIG. 3 illustrates a structure of a conveyance guide unit provided in the conveyance unit.
Figure 4:
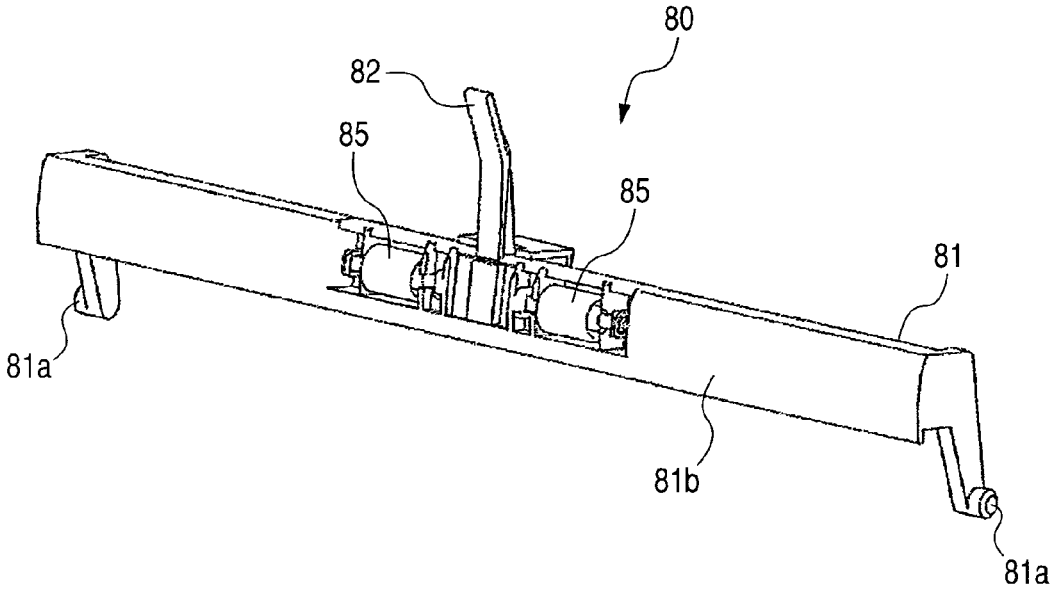
FIG. 4 illustrates a structure of a sheet pressure-contact unit provided in the conveyance unit.

Further, the type of the sheet is discriminated, and control is performed such that the conveying speed of the sheet is changed according to the result of the discrimination. For example, when the sheet is heavy paper which is thicker than plain paper, because the heat capacity of heavy paper is larger than that of plain paper, if the conveying speed of heavy paper when the toner image is fixed thereon is the same as that for the plain paper, the fixability becomes worse. Therefore, when the result of the discrimination is that the sheet is heavy paper, the conveying speed of the sheet is set to be lower than that of the plain paper such that the amount of heat supplied to the heavy paper per unit time becomes larger. Further, control is performed such that the fixing temperature is changed according to the basis weight of the sheet. For example, with regard to a sheet which is comparatively thick, because the heat capacity of the sheet is large, the fixing temperature is controlled to be higher, while, with regard to a sheet which is comparatively thin, that is, with regard to a sheet having a small heat capacity, the fixing temperature is controlled to be lower. Further, control may be performed such that the sheet conveying speed is changed according to the basis weight of the sheet. Further, when the result of the discrimination is that the sheet is an OHT sheet or gloss paper, control may be performed such that the fixability of the toner attached to the surface of the sheet is made higher to increase the gloss, thereby improving the quality of the image. In this way, in this embodiment, control is performed such that the developing bias condition, the fixing temperature, or the sheet conveying speed is changed according to the result of discrimination (detection) of a characteristic of the sheet. As illustrated in FIG. 3, the conveyance guide unit 88 is provided with a guide member 86 which forms a guide surface 86*a* and holds the discriminating sensor portion 83*b*. The guide member 86 defining the sheet conveying path 8 has conveying ribs 86*b* extending in a sheet conveying direction. Drive rollers 20*a* constituting the registration roller pair 20 protrude from the guide member 86 into the sheet conveying path. As illustrated in FIG. 2, the sheet pressure-contact unit 80 includes a pivotable member 81 for holding the LED 83*a* for transmitted light and a pair of rotatable pressure-contact rotatable members 85 held by the pivotable member 81 and disposed at both sides of the sheet discrimination unit 83 so as to interpose the sheet discrimination unit 83 therebetween. The pivotable member 81 is urged counterclockwise by a compression spring 84 so as to rotate about a center 81*a* of rotation. The pressure-contact rotatable members 85 as pressure members have a center of rotation the phase of which is the same as that of the LED 83*a* for transmitted light in the sheet conveying direction. As illustrated in FIG. 4, the pressure-contact rotatable members 85 are in pressure contact with the guide surfaces 86*a* (see FIG. 3) which are a part of the guide member 86 disposed so as to be opposed to the pressure-contact rotatable members 85 with the sheet conveying path 8 interposed therebetween in a width direction orthogonal to the sheet conveying direction. The pivotable member 81 as a holding member configured to hold the pressure-contact rotatable members 85 is normally urged by the compression spring 84 to be held at a pressure position at which the sheet is pressed against the guide surfaces 86*a* by the pressure-contact rotatable members 85.

Further, a guide surface 81*b* defining a part of the sheet conveying path 8 in cooperation with the guide member 86 of the conveyance guide unit 88 is provided at a rotating end portion of the pivotable member 81. More specifically, in this embodiment, a part of the sheet conveying path 8 is defined by the pivotable member 81 of the sheet pressure-contact unit 80 and the guide member 86 of the conveyance guide unit 88. Further, the sheet pressure-contact unit 80 includes a pressure-contact relaxing arm 82 a distal end portion of which intersects the sheet conveying path 8 downstream of the detecting position of the sheet discrimination unit 83 for detecting the characteristic of the sheet in the sheet conveying direction and which is a moving member integral with the pivotable member 81. As described in the following, by including the pressure-contact relaxing arm 82 the distal end portion of which intersects the sheet conveying path 8, the pivotable member 81 is pushed by the sheet via the pressure-contact relaxing arm 82 when the sheet passes through the sheet conveying path 8, and is rotated clockwise about the center 81*a* of rotation. As a result, the pivotable member 81 moves to a pressure releasing position (a retracted position) at which the pressure of the pressure-contact rotatable members 85 pressing the sheet against the guide surface 86*a* is released. When the pivotable member 81 which is movable from the pressure position to the pressure releasing position moves to the pressure releasing position in this way, the pressure-contact rotatable members 85 are separated from the guide surface 86*a* of the guide member 86, and thus, wear of the guide surface 86*a* by sliding and rubbing by the sheets P can be alleviated. It is to be noted that, here, as an example, the pressure releasing position is a position at which the pressure-contact rotatable members 85 are spaced apart from the guide surface 86*a* of the guide member 86 such that the pressure-contact rotatable members 85 do not at all press the sheet against the guide surface 86*a*. However, the pressure releasing position may be any position at which the amount of abrasion of the guide surface 86*a* due to the pressing force by the pressure-contact rotatable members 85 can be decreased. For example, the pressure releasing position may be a position at which the pressure-contact rotatable members 85 are in slight contact with the guide surface 86*a*.

Figure 5B:
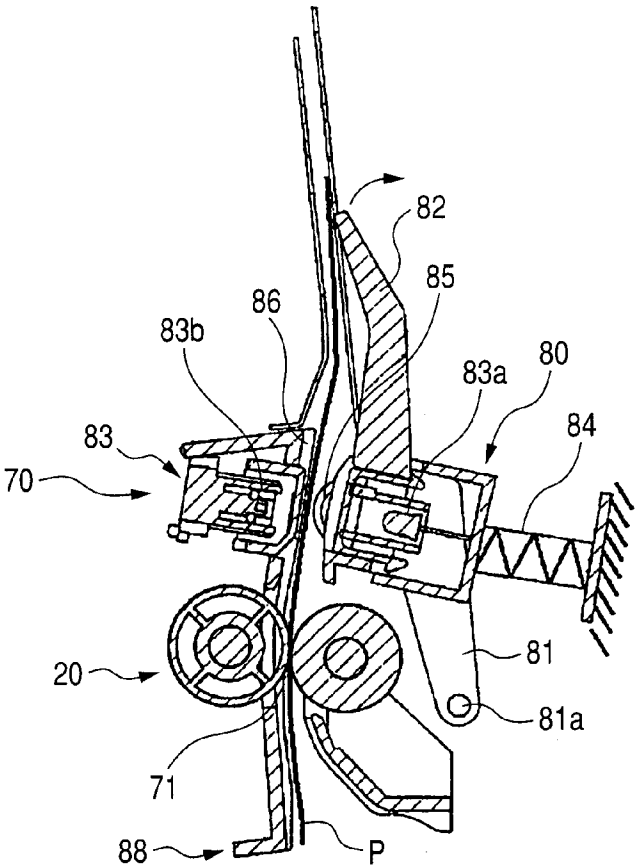
FIGS. 5A and 5B illustrate states of the conveyance unit when a sheet passes through the conveyance unit.
Figure 5A:
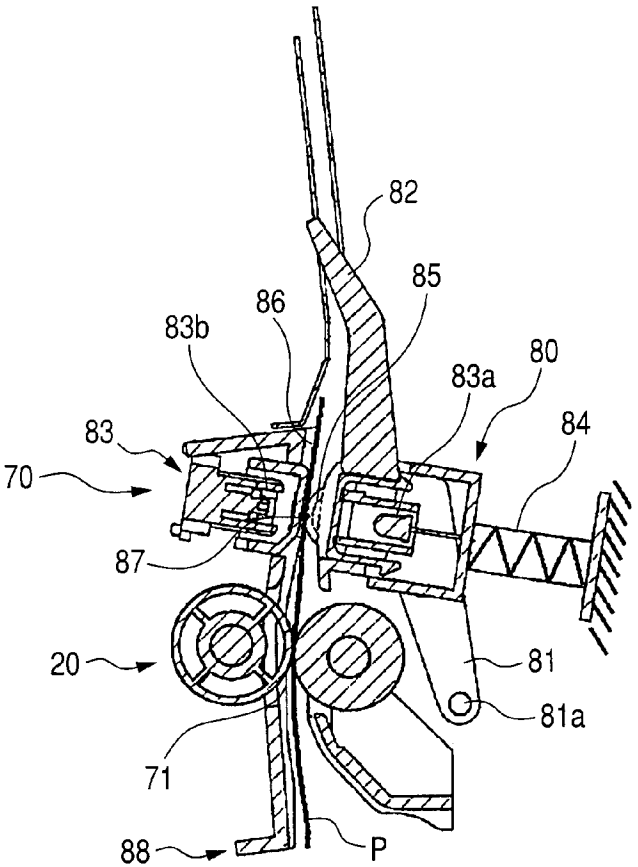

Next, a sheet conveying operation of the conveyance unit 70 structured in this way will be described. For example, a sheet P contained in the sheet feed cassette is fed by the feeding roller 13 to reach the registration roller pair 20 provided in the sheet conveying path 8 and rotated by a drive source (not shown). Then, the sheet P is conveyed by the registration roller pair 20 to a detection nip portion 87 formed between (the guide surfaces 86*a* of) the guide member 86 and the pressure-contact rotatable members 85 of the sheet conveyance unit 70 which is disposed downstream of the registration roller pair 20 and is caught in the detection nip portion 87. A flutter of the sheet P caught in the detection nip portion in this way can be suppressed. After that, as illustrated in FIG. 5A, the sheet P is temporarily stopped in a focal position of the sheet discrimination unit 83.

With the sheet P being temporarily stopped in the focal position of the sheet discrimination unit 83 in this way, a detecting operation for discriminating the type of the sheet P is performed. After the detecting operation is completed, the sheet P is again conveyed by the registration roller pair 20 to reach the pressure-contact relaxing arm 82. When the sheet P is conveyed farther, the distal end portion of the pressure-contact relaxing arm 82 which intersects the sheet conveying path 8 is pushed by the sheet P, which makes the pivotable member 81 rotate clockwise integrally with the pressure-contact relaxing arm 82 about the center 81*a* of rotation as illustrated in FIG. 5B. When the pivotable member 81 rotates in this way, the pressure-contact rotatable members 85 are spaced apart from the guide surfaces 86*a* of the guide member 86, and thus, wear of the guide surface 86*a* by sliding and rubbing by the sheets P can be alleviated. After that, when the sheet P completely passes, the pressure-contact relaxing arm 82 is returned integrally with the pivotable member 81 by the compression spring 84 to the position at which the distal end portion thereof intersects the sheet conveying path 8.

As described in the above, in this embodiment, after the detection by the sheet discrimination unit 83, when the pressure-contact relaxing arm 82 is pushed by a sheet passing through the sheet conveying path 8, the pivotable member 81 moves to the pressure releasing position at which the pressure of the pressure-contact rotatable members 85 pressing the sheet is released. This can decrease the amount of abrasion of the guide surfaces 86*a* of the guide member 86 by the conveyed sheets. As a result, it is hard to change the focal position of the discriminating sensor portion 83*b* so that it becomes more certainty to improve the durability of the detecting performance of the sensor and it is possible to prevent reduction of the detection accuracy of the sheet discrimination unit 83.

Because pushing force from the sheet is used to move the pivotable member 81 to the pressure releasing position, an additional driving portion (such as a motor) for moving the pivotable member 81 is not required, and thus, a compact sheet conveying apparatus can be manufactured at a low cost.

Further, because the pressure-contact relaxing arm 82 is pushed by a sheet, the type of which is discriminated, downstream of the detecting position of the sheet discrimination unit 83 in the sheet conveying direction, the type of the sheet can be discriminated in an early stage of the sheet conveyance process. It is to be noted that an apparatus in which the detection timing is not required to be early may be structured such that the pressure-contact relaxing arm is pushed by the sheet upstream of the detecting position of the sheet discrimination unit 83 in the sheet conveying direction and such that, after the sheet passes the pressure-contact relaxing arm 82, the type of the sheet is discriminated by the sheet discrimination unit 83.

Figure 6:
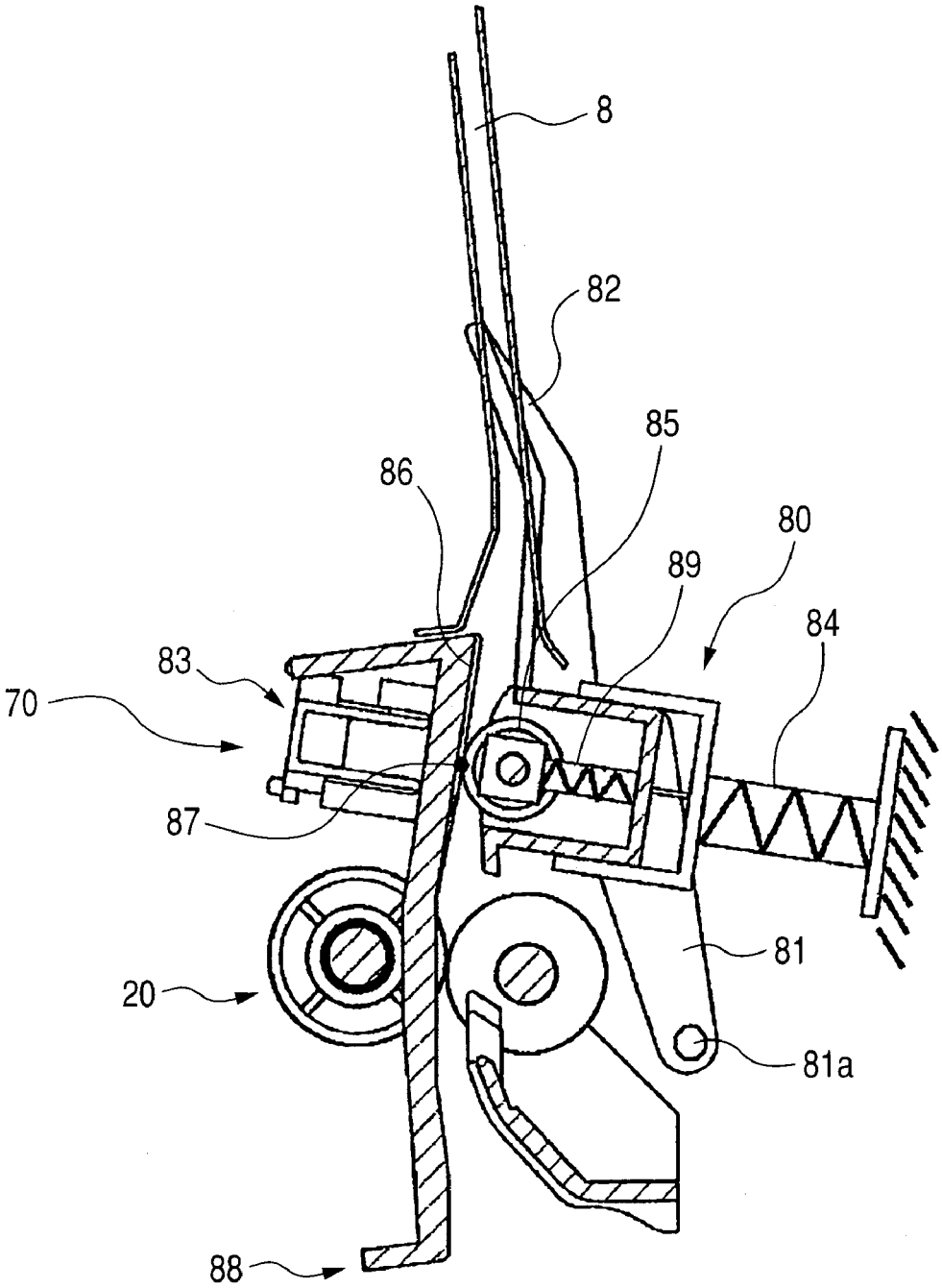
FIG. 6 illustrates a structure of a conveyance unit as a sheet conveying apparatus according to a second embodiment of the present invention.
Figure 7B:
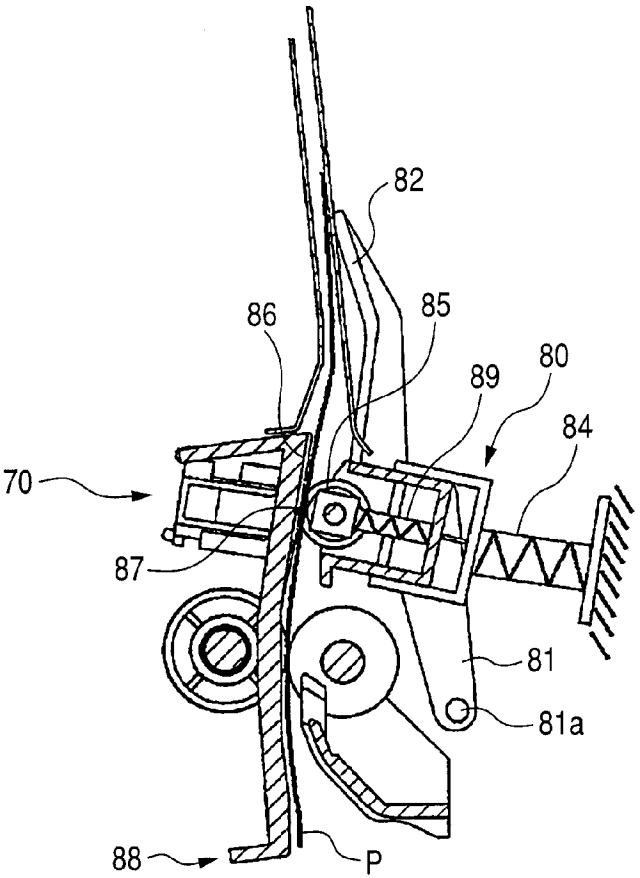
FIGS. 7A and 7B illustrate states of the conveyance unit when a sheet passes through the conveyance unit.
Figure 7A:
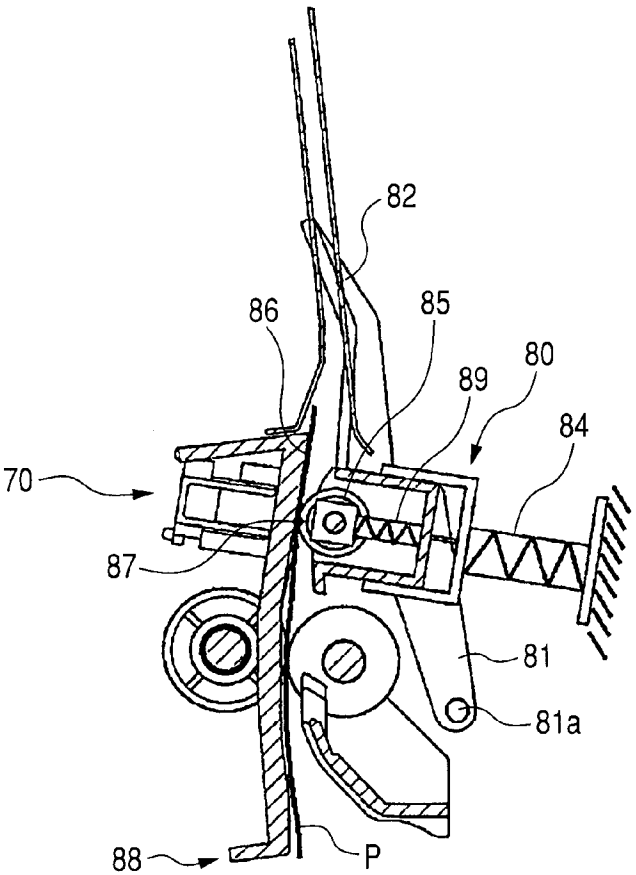

Next, a second embodiment of the present invention will be described. FIG. 6 illustrates a structure of a conveyance unit as a sheet conveying apparatus according to this embodiment. It is to be noted that, in FIG. 6, reference symbols which are the same as those in FIG. 2 designate the same or corresponding members as those of FIG. 2. In FIG. 6, a sheet pressure-contact rotatable member urging spring 89 is an urging member for urging the pressure-contact rotatable members 85 to the guide surface side of the guide member 86 which is on the guide member side. The sheet pressure-contact rotatable member urging spring 89 is disposed between the pressure-contact rotatable members 85 and the pivotable member 81. The pressure-contact rotatable members 85 are urged by the sheet pressure-contact rotatable member urging spring 89 so as to be in pressure contact with the guide surface 86*a* disposed so as to be opposed to the pressure-contact rotatable members 85 with the sheet conveying path 8 interposed therebetween. As illustrated in FIG. 7A, when a sheet P passes through the detection nip portion 87, a flutter of the sheet P can be suppressed by the sheet pressure-contact rotatable member urging spring 89 and the compression spring 84 for urging the pivotable member 81, and the sheet P is temporarily stopped in the focal position of the sheet discrimination unit 83. With this state being maintained, a detecting operation for discriminating a characteristic of the sheet P is performed.

After the detecting operation is completed, the sheet P is conveyed again by the registration roller pair 20. When the sheet P reaches the pressure-contact relaxing arm 82, as illustrated in FIG. 7B, the distal end portion of the pressure-contact relaxing arm 82 is pushed by the sheet P, which makes the pivotable member 81 rotate clockwise integrally with the pressure-contact relaxing arm 82 about the center 81*a* of rotation to move to a pressure contact releasing position (a retracted position). In this state, although the pressure-contact rotatable members 85 are made to be in contact with the guide surface 86*a* by the urging force by the sheet pressure-contact rotatable member urging spring 89, because the pivotable member 81 which is a main body of the sheet pressure-contact unit 80 is moved in a direction away from the guide surface 86*a* by the pushing force from the sheet, the pressing force applied to the conveyed sheet and the guide surface 86*a* of the guide member 86 by the pressure-contact rotatable members 85 is reduced. Therefore, as wear of the guide surface 86*a* by sliding and rubbing by the sheets P can be alleviated, it is hard to change the focal position of the discriminating sensor portion 83*b* so that the durability of the detecting performance of the sensor can be improved. Further, because the pressure contact with the sheet P is maintained even after the detecting operation by the sheet discrimination unit 83 is completed, an image failure caused by a flutter of a rear end of the sheet P can be alleviated. Also in this embodiment, control is performed such that the developing bias condition, the fixing temperature, or the sheet conveying speed is changed according to the result of discrimination of the type of the sheet.

Figure 8:
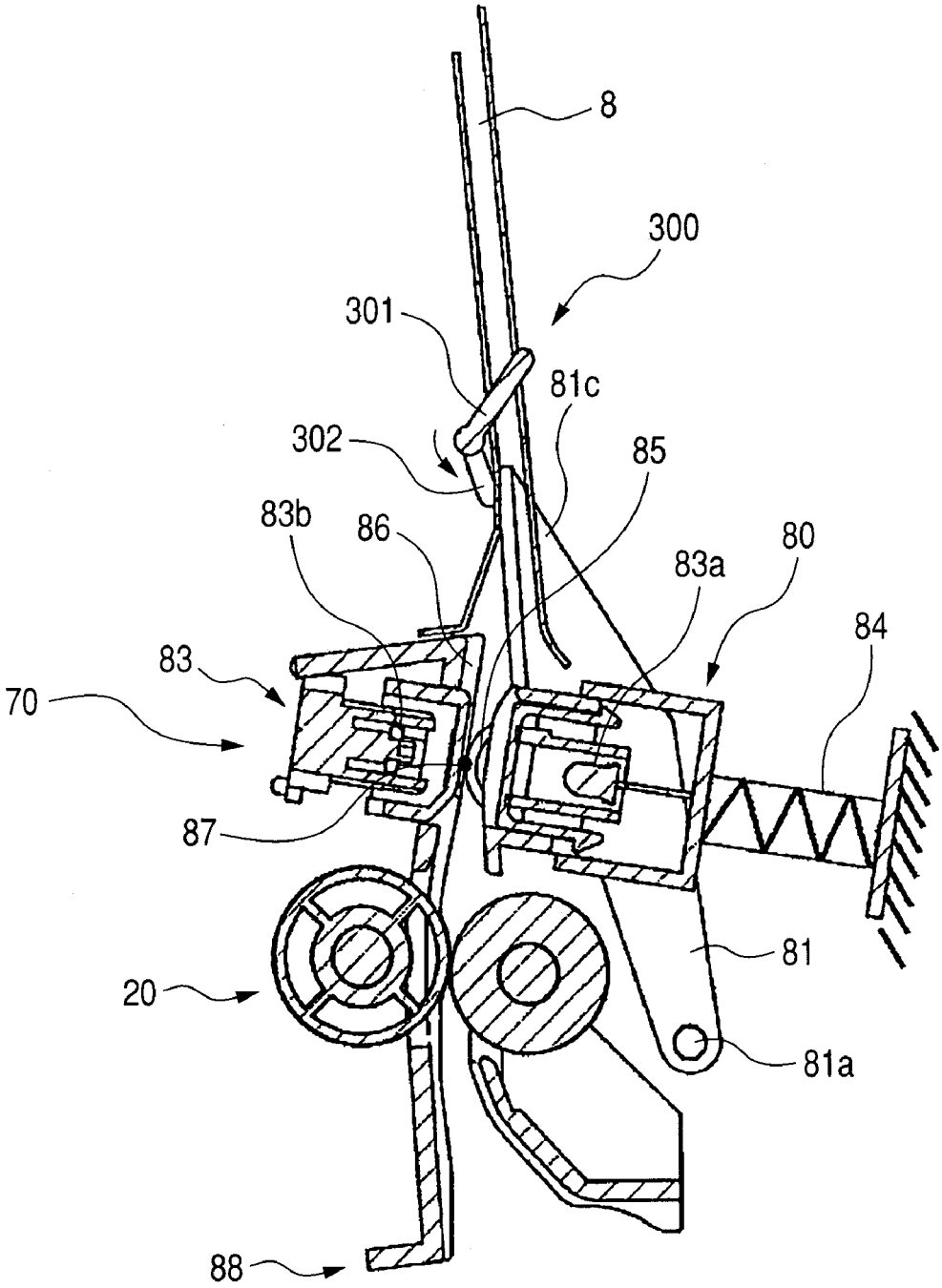
FIG. 8 illustrates a structure of a conveyance unit as a sheet conveying apparatus according to a third embodiment of the present invention.
Figure 9:
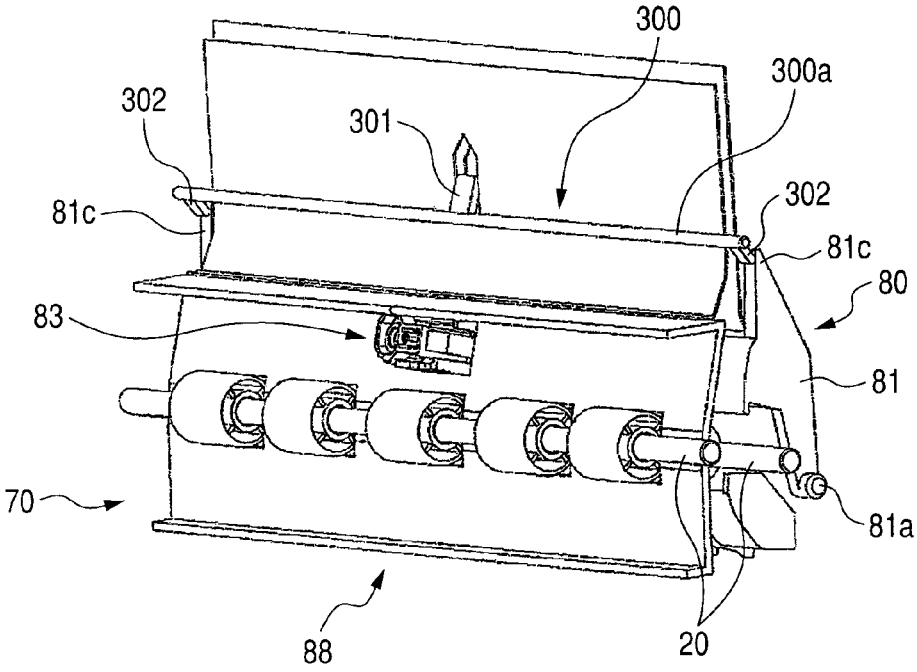
FIG. 9 is a first view of illustrating a structure of a pressure-contact reducing flag provided in the conveyance unit.
Figure 10:
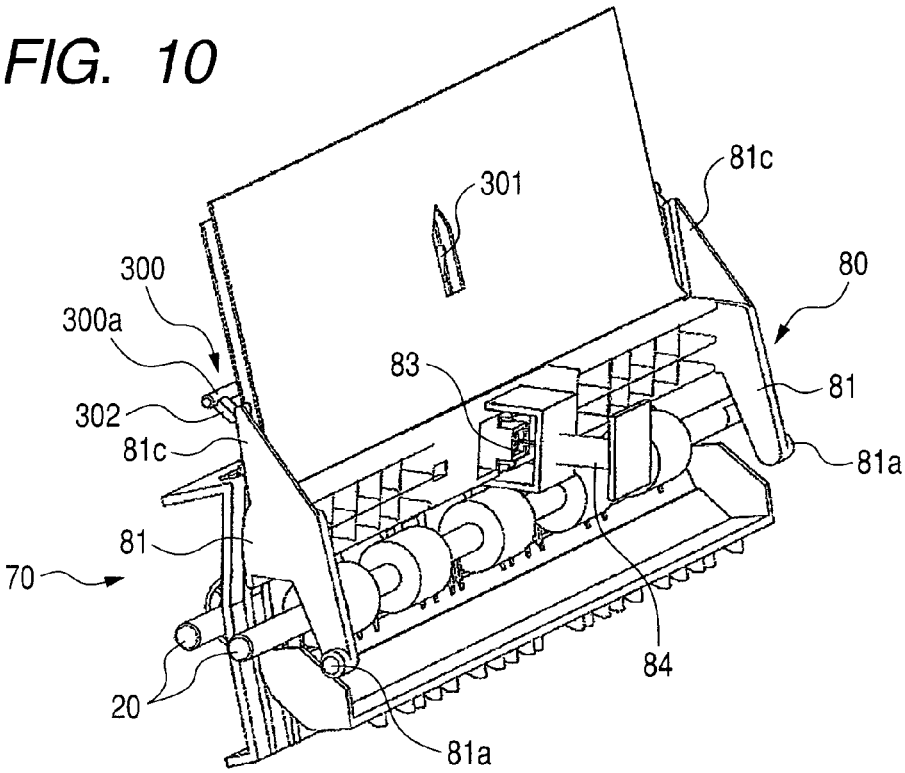
FIG. 10 is a second view of illustrating the structure of the pressure-contact reducing flag provided in the conveyance unit.

Next, a third embodiment of the present invention will be described. FIG. 8 illustrates a structure of a conveyance unit as a sheet conveying apparatus according to this embodiment. It is to be noted that, in FIG. 8, reference symbols which are the same as those in FIG. 2 designate the same or corresponding members illustrated in FIG. 2. In FIG. 8, a pressure-contact reducing flag 300 in this embodiment as a moving member is movably held by a conveyance guide on the guide member side. As illustrated in FIGS. 9 and 10, an abutting portion 301 for intersecting the sheet conveying path 8 is provided at a center portion in a width direction of a flag main body 300*a* of the pressure-contact reducing flag 300. Further, pushing portions 302 which abut upper end portions 81*c* of the pivotable members 81 urged by the compression spring 84 is provided at both end portions of the flag main body 300*a* in the width direction thereof outside the sheet P.

Figure 11B:
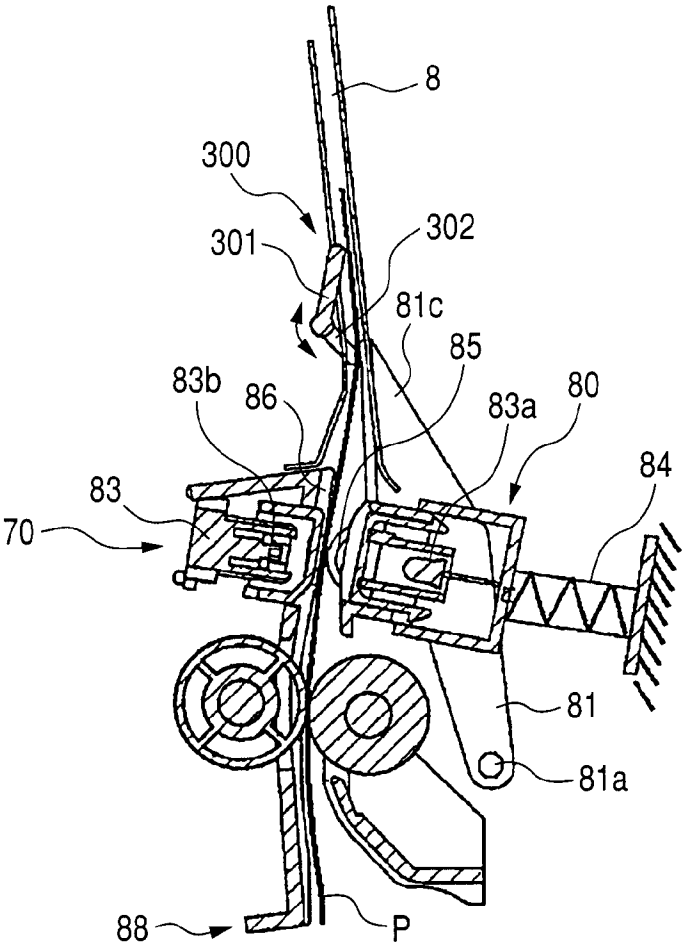
FIGS. 11A and 11B illustrate states of the conveyance unit when a sheet passes through the conveyance unit.
Figure 11A:
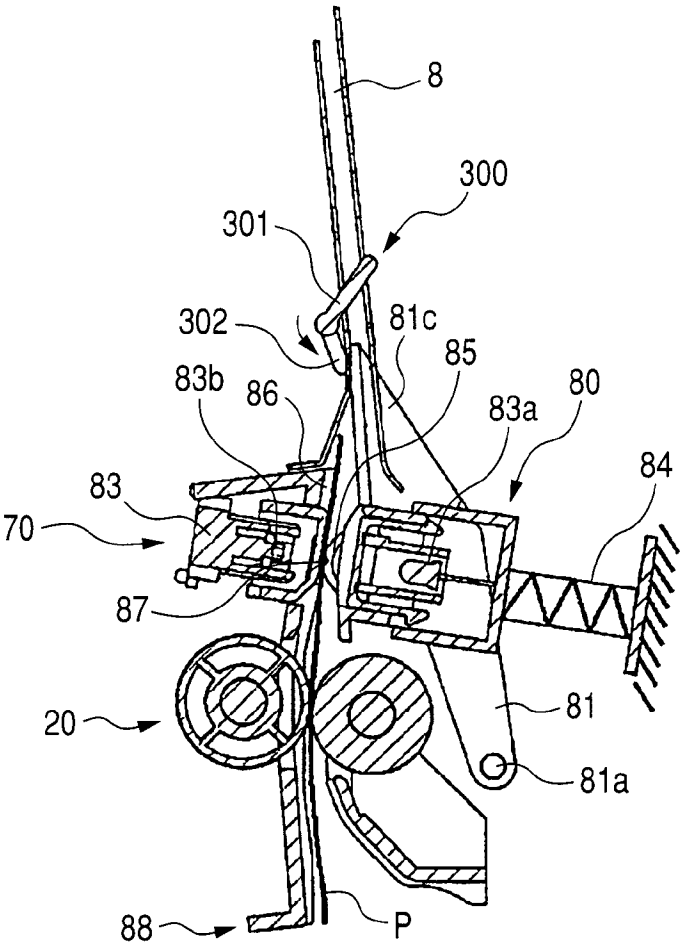

Next, a sheet conveying operation of the conveyance unit 70 structured in this way will be described. For example, a sheet P contained in the sheet feed cassette is fed by the feeding roller 13 to reach the registration roller pair 20. Then, the sheet P is conveyed by the registration roller pair 20 to the detection nip portion 87 and is caught therein. A flutter of the sheet P caught in the detection nip portion 87 in this way can be suppressed, and, as illustrated in FIG. 11A, the sheet P is temporarily stopped in the focal position of the sheet discrimination unit 83. With the sheet P being temporarily stopped in the focal position of the sheet discrimination unit 83 in this way, the detecting operation is performed. After the detecting operation is completed, the sheet P is again conveyed by the registration roller pair 20 to reach the pressure-contact reducing flag 300. After that, when the sheet P is conveyed farther, the abutting portion 301 of the pressure-contact reducing flag 300 which intersects the sheet conveying path 8 is pushed by the sheet P, which makes the pressure-contact reducing flag 300 rotate counterclockwise as illustrated in FIG. 11B. Along with this, the pushing portions 302 of the pressure-contact reducing flag 300 pushes the upper end portions 81*c* of the pivotable members 81, and the pivotable members 81 rotate clockwise about the center 81*a* of rotation.

When the pivotable members 81 rotate in this way, the pressure-contact rotatable members 85 are spaced apart from the guide surface 86*a* of the guide member 86, and thus, wear of the guide surface 86*a* by sliding and rubbing by the sheets P can be alleviated. After that, when the sheet P has passed the pressure-contact reducing flag 300, the pressure-contact reducing flag 300 is pushed by the upper end portions 81*c* of the pivotable members 81 urged by the compression spring 84, and the pressure-contact reducing flag 300 returns to the position at which the abutting portion 301 intersects the sheet conveying path 8.

Even when the pressure-contact reducing flag 300 as a moving member is provided on the conveyance guide side as in this embodiment, the pressure applied to the guide surface 86*a* of the guide member 86 by the pressure-contact rotatable members 85 can be reduced. Further, by providing the pressure-contact reducing flag 300 on the conveyance guide side as in this embodiment, the jam clearance from the side of the sheet pressure-contact unit when the sheet P is jammed can be improved.

Figure 12:
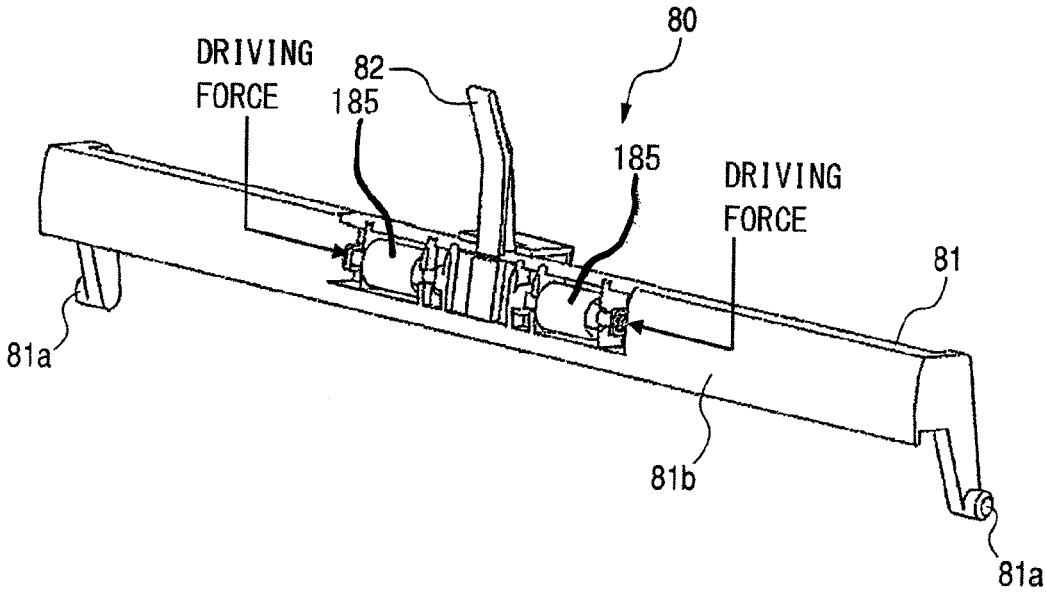
FIG. 12 is a view showing a drive roller.

It is to be noted that, in the first to third embodiments described in the above, the pressure-contact rotatable members are used as the pressure member configured to press a sheet against the guide surface 86*a*, but the present invention is not limited thereto. A drive roller 185 which is rotated by driving force transmitted thereto may be used as the pressure member (FIG. 12). By using a drive roller as the pressure member in this way, a force of conveying the sheet P can be assisted and resistance caused when the sheet P is conveyed can be reduced, which can improve the detection accuracy of the sheet discrimination unit 83. Further, the pressure member is not limited to a rotating member such as the rotatable members and the drive roller and may be a plate-like member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-111006, filed Apr. 30, 2009, which is hereby incorporated by reference herein in its entirety.

What is claimed is:

1. A sheet conveying apparatus, comprising:

a sheet conveying path through which a sheet is conveyed;

a sensor unit configured to output a signal according to a characteristic of the sheet which is conveyed through the sheet conveying path;

a pressure unit configured to press the sheet against the sensor unit; and a moving member protruding into the sheet conveying path downstream of a sensing position of the sensor unit in a sheet conveying direction so that the moving member is moved by the sheet passing through the sheet conveying path after the characteristic of the sheet is sensed by the sensor unit, wherein the pressure unit is interlocked with the moving member so that the sheet is pressed by the pressure unit against the sensor unit when the moving member is not pushed by the sheet, and a pressure force on the sheet applied by the pressure unit is released or reduced when the moving member is pushed by the sheet.

2. A sheet conveying apparatus according to claim 1, wherein the pressure unit has a pressure member configured to press the sheet against the sensor unit and a holding member configured to hold the pressure member, the holding member being movable between a pressure position at which the sheet is pressed by the pressure member and a retracted position at which the pressure force on the sheet applied by the pressure member is released or reduced, and the moving member moves the holding member from the pressure position to the retracted position when the moving member is pushed by the sheet passing through the sheet conveying path.

3. A sheet conveying apparatus according to claim 2, wherein the moving member is provided on the holding member; and the holding member is moved from the pressure position to the retracted position together with the moving member pushed by the sheet.

4. A sheet conveying apparatus according to claim 1, wherein the sensor unit comprises:

a guide member defining the sheet conveying path; and a sensor configured to output a signal according to a characteristic of the sheet guided by the guide member, and wherein the moving member is movably held by the guide member, and the holding member is pushed by the moving member pushed by the sheet to move from the pressure position to the retracted position.

5. A sheet conveying apparatus according to claim 2, further comprising an urging member configured to urge the pressure member to a side of the sensor unit.

6. A sheet conveying apparatus according to claim 2, wherein the pressure member is a drive roller which is rotated by a driving force transmitted to the drive roller.

7. An image forming apparatus, comprising:

a sheet conveying path through which a sheet is conveyed;

an image forming portion configured to form an image on the sheet conveyed through the sheet conveying path;

a sensor unit configured to output a signal according to a characteristic of the sheet which is conveyed through the sheet conveying path;

a pressure unit configured to press the sheet against the sensor unit; and a moving member protruding into the sheet conveying path downstream of a sensing position of the sensor unit in a sheet conveying direction so that the moving member is moved by the sheet passing through the sheet conveying path after the characteristic of the sheet is sensed by the sensor unit, wherein the pressure unit is interlocked with the moving member so that the sheet is pressed by the pressure unit against the sensor unit when the moving member is not pushed by the sheet, and a pressure force on the sheet applied by the pressure unit is released or reduced when the moving member is pushed by the sheet.

8. An image forming apparatus according to claim 1, wherein the pressure unit has a pressure member configured to press the sheet against the sensor unit and a holding member configured to hold the pressure member, the holding member being movable between a pressure position at which the sheet is pressed by the pressure member and a retracted position at which the pressure force on the sheet applied by the pressure member is released or reduced, and the moving member moves the holding member from the pressure position to the retracted position when the moving member is pushed by the sheet passing through the sheet conveying path.

9. An image forming apparatus according to claim 8, wherein the moving member is provided on the holding member; and the holding member is moved from the pressure position to the retracted position together with the moving member pushed by the sheet.

10. An image forming apparatus according to claim 8, wherein the sensor unit comprises:

a guide member defining the sheet conveying path; and a sensor configured to output a signal according to a characteristic of the sheet guided by the guide member, and wherein the moving member is movably held by the guide member, and the holding member is pushed by the moving member pushed by the sheet to move from the first position to the second position.

11. An image forming apparatus according to claim 8, further comprising an urging member configured to urge the pressure member to a side of the sensor unit.

12. An image forming apparatus according to claim 8, wherein the pressure member is a drive roller which is rotated by a driving force transmitted to the drive roller.

13. An image forming apparatus according to claim 7, wherein the image forming portion changes an image formation condition according to the characteristic of the sheet detected by the detection unit.

14. A sheet conveying apparatus according to claim 1, wherein the moving member intersects the sheet conveying path in a thickness direction of the sheet.

15. An image forming apparatus according to claim 7, wherein the moving member intersects the sheet conveying path in a thickness direction of the sheet.

* * * * *